United States Patent [19]

Bolldorf

[11] 4,362,114

[45] Dec. 7, 1982

[54] TABLE TOP EMBROIDERING MACHINE HAVING A PLURALITY OF EMBROIDERING UNITS AND TO AN ADJUSTABLE TABLE TOP THEREFOR

[75] Inventor: Kurt Bolldorf, Kaiserslautern, Fed. Rep. of Germany

[73] Assignee: Pfaff Industriemaschinen GmbH, Fed. Rep. of Germany

[21] Appl. No.: 185,898

[22] Filed: Sep. 10, 1980

[30] Foreign Application Priority Data

Sep. 21, 1979 [DE] Fed. Rep. of Germany ... 7926754[U]

[51] Int. Cl.[3] ..... D05C 3/02; A47B 29/00

[52] U.S. Cl. ..... 112/217.2; 108/77; 108/80; 312/281; 112/155

[58] Field of Search ..... 108/77, 80; 112/217.2, 112/98, 217.1, 155; 312/281

[56] References Cited

U.S. PATENT DOCUMENTS

| | | | |
|---|---|---|---|
| 845,471 | 2/1907 | Mitchell | 112/217.1 |
| 1,533,170 | 4/1925 | Dosch | 112/217.2 |
| 2,993,740 | 7/1961 | Good | 108/80 |
| 4,037,896 | 7/1977 | Kennedy, Jr. et al. | 312/281 |
| 4,290,657 | 9/1981 | Haas | 112/217.1 X |

*Primary Examiner*—H. Hampton Hunter
*Attorney, Agent, or Firm*—McGlew and Tuttle

[57] ABSTRACT

A table top for an embroidering machine having a plurality of embroidering units with stitch plates which are arranged in a plane on an associated embroidering frame, comprises a step bearing adapted to be secured in position adjacent the frame. A bearing strap is pivotally mounted in the step bearing for rotation about a horizontal axis and it carries a table top which may be pivoted therewith between a horizontal position aligned adjacent the plane of the stitch plates to a substantially vertical position below the stitch plates. The pivot for the strap is located in a horizontal plane below the assemblies of the embroidering units. The position of the table may be finally adjusted by means of an adjusting screw. Construction includes a control shaft for actuating the embroidering units which are located beneath the units and extend over the entire length of the table top and is displaceable for controlling the embroidering machines.

8 Claims, 2 Drawing Figures

TABLE TOP EMBROIDERING MACHINE HAVING A PLURALITY OF EMBROIDERING UNITS AND TO AN ADJUSTABLE TABLE TOP THEREFOR

FIELD AND BACKGROUND OF THE INVENTION

This invention relates in general to sewing or embroidering machines and in particular to a new and useful table top construction for an embroidering machine which has a plurality of embroidering units with individual stitch plates arranged in a plane on an associated frame and to a construction in which the table tops adjacent the embroidering units may be tilted between a horizontal to a vertical position.

In known table top embroidering machines, embroidering units are inserted in individual sections of the table top of the machine frame so that the top side of the table and of the stitch plate lie on one plane. Since the cloth support slide customary in embroidering units is arranged at the same level as the table top and the stitch plate, it can only be opened, for example, to expose the looper if the respective embroidering unit is slightly raised. But raising the individual embroidering unit is not readily possible, because the assemblies of the embroidering units, which are identical, like thread take-ups or needle bars, are driven from a continuous shaft common to all the embroidering units. The embroidering units are thus connected with each other by drive shafts. In order to reach the bottom stitch-forming tools and other devices, it is therefore necessary to reach under the table top at the operating end. This inconvenience may be acceptable when changing a bobbin. But if adjustments have to be made on the loopers, or the thread monitor looper, or the thread cutters, this poor accessibility results naturally in higher time expenditures. The resulting loss of production naturally manifests itself to higher costs.

Accordingly, it is an object of the invention to provide a construction for an embroidery machine which includes a plurality of embroidering units having individual stitch plates arranged adjacent a frame plane and including a table top which is adapted to be mounted adjacent the frame and which is pivotable between a substantially horizontal to a substantially vertical position.

A further object of the invention is to provide a table top construction for embroidering machines which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing in which preferred embodiments of the invention are illustrated.

DESCRIPTION OF THE PREFERRED EMBODIMENTS

Figure 1:
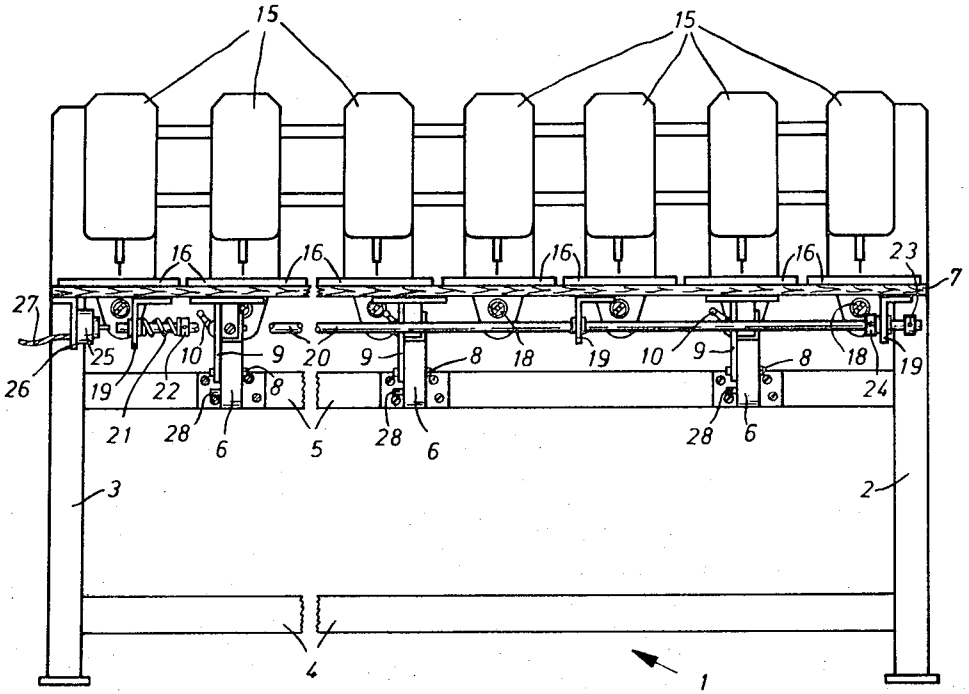
FIG. 1 is a simplified front elevational view of a table top embroidering machine constructed in accordance with the invention.

Referring to the drawings in particular the invention embodied therein comprises a table top embroidering machine which has a plurality of embroidering units 15 each with individual stitch plates 16 arranged in a plane on an embroidering frame 1. In accordance with the invention a table top 7 is adjustably positionable on a bearing strap 9 which is pivoted on a substantially horizontal axis in a step bearing 6 which is secured to an upright column 2 of the frame 1.

Figure 2:
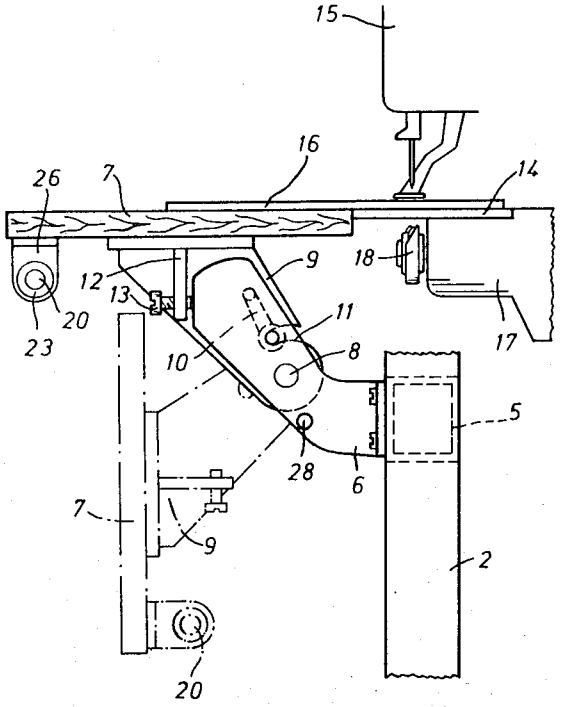
FIG. 2 is a side elevational view of the embroidering machine in an enlarged scale.

Frame of the table top embroidering machine has lateral columns 2 and 3 which are connected by cross struts 4 and 5. On one cross strut 5 are secured several step bearings 6, which serve to support a table top 7 arranged at the operating end, on the underside of which are secured several bearing straps 9 which are pivotally mounted on a horizontal axle and pivot on end step bearings 6. In order to lock the table top 7 in its operating position, indicated in solid lines in FIG. 2, a tommy screw 10 is provided for each bearing strap 9 and the respective step bearing 6, which passes through an arched slot 11, open at one end, in bearing straps 9 and is screwed into step bearing 6. On each bearing strap 9 is provided a lug 12 with an adjusting screw 13, which bears on the respective step bearing 6 and permits adjustment of table top 7 about the horizontal axle-end pivots 8, so that table top 7 can be adjusted parallel to stitch plates 14 of jointly driven embroidering units 15 arranged on machine frame 1 so that embroidering frames 16 associated with embroidering units 15 and secured on a mechanically or electronically controlled cross slide bear on a plane surface on which they are displaced jointly during the embroidering in two perpendicular directions corresponding to the embroidering pattern to be produced.

Under stitch plate 14 of each embroidering unit 15 is arranged a looper bearing block 17 with a looper 18 and other devices not shown here, e.g. a thread cutter and a looper thread monitor.

On the underside of the table top are arranged several bearing angles 19 in which a control shaft 20 extending over the entire length of table top 7 is mounted for axial displacement. It is under the action of a return spring 21 which is arranged between an adjusting ring 22 secured thereon and a bearing angle 19. The axial path of control shaft 20 is limited by two adjusting rings 23 and 24. Control shaft 20 actuates control switch 25 of the embroidering machine, which is arranged on an angle 26 secured on table top 7. From control switch 25 a flexible electrical cable 27 leads to a switch box (not shown). Due to the fact that control shaft 20 extends over the entire length of table top 7, the embroidering machine can be turned on and off from any point.

If adjusting or maintenance operations have to be performed on the assemblies arranged under table top 7 or stitch plate 14, access to these assemblies can be cleared very simply by folding table top 7, after loosening tommy screws 10, from its operating position represented by solid lines about axle-end pivots 8 into the maintenance position indicated by broken lines, in which bearing straps 9 bear on steps 28 in step bearings 6. Due to the position of axle-end pivots 8 underneath the lower assemblies 17 of embroidering units 15 and ahead of these assemblies, table top 7 swings sufficiently far away from the lower assemblies to make the latter easily accessible.

While specific embodiments of the invention have been shown and described in detail to illustrate the application of the principles of the invention, it will be understood that the invention may be embodied otherwise without departing from such principles.

What is claimed is:

1. A table top embroidering machine having a plurality of embroidering units with stitch plates arranged in a plane on an associated embroidering frame, comprising a step bearing adapted to be secured in position adjacent the frame, a bearing strap pivotally mounted on said step bearing for rotation about a horizontal axis, the table top carried on said bearing strap and being pivotal with said bearing strap between a horizontal position aligned adjacent the plane of the stitch plates to a substantially vertical position below the stitch plates.

2. A table top embroidering machine according to claim 1, wherein said pivot is arranged in a horizontal plane beneath the embroidering units.

3. A table top according to claim 1, including means for adjusting position of the table top when it is substantially horizontal to position it relative to the stitch plates.

4. A table top according to claim 3, said adjusting means including a lug carried by said bearing strap, an adjusting screw threaded into said lug and adapted to bear against said step bearing for positioning said bearing strap relative to said step bearing.

5. A table top according to claim 1 wherein said step bearing includes an angle member having a lower substantially horizontal portion secured to said frame and an obliquely extending portion with a top surface carrying said table with said step bearing having a curved groove, the bearing strap including a pin member engaged in said curved groove.

6. A table top according to claim 1 including an embroidering frame having spaced apart upright columns, a plurality of brackets supported on said frame at spaced locations therebetween and a control shaft mounted in said brackets for axial movement, and a switch member alongside said control shaft and being actuatable by movement of said control shaft, said control shaft being engageable at any point along the length of said embroidering frame for controlling the operation of said switch, said switch, controlling the operation of the embroidering units.

7. A table top according to claim 6 including means for limiting the axial movement of said control shaft.

8. A table top according to claim 7 including spring means biasing said control shaft in an axial direction away from said switch.

* * * * *